US010436103B2

(12) United States Patent
Quix et al.

(10) Patent No.: US 10,436,103 B2
(45) Date of Patent: Oct. 8, 2019

(54) LIQUID-COOLED INTERNAL COMBUSTION ENGINE COMPRISING A CYLINDER BLOCK, AND METHOD FOR PRODUCING AN ASSOCIATED CYLINDER BLOCK

(71) Applicant: Ford Global Technologies, LLC, Dearborn, MI (US)

(72) Inventors: Hans Guenter Quix, Herzogenrath (DE); Klaus-Peter Heinig, Aachen (DE); David van Bebber, Aachen (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 178 days.

(21) Appl. No.: 15/786,457

(22) Filed: Oct. 17, 2017

(65) Prior Publication Data

US 2018/0135504 A1 May 17, 2018

(30) Foreign Application Priority Data

Nov. 11, 2016 (DE) ..... 10 2016 222 184

(51) Int. Cl.

| | |
|---|---|
| ***F01P 11/04*** | (2006.01) |
| ***F01P 3/02*** | (2006.01) |
| ***F01P 7/14*** | (2006.01) |
| ***F02F 1/14*** | (2006.01) |

(52) U.S. Cl.

CPC ..... *F01P 11/04* (2013.01); *F01P 3/02* (2013.01); *F01P 7/14* (2013.01); *F02F 1/14* (2013.01); *F01P 2003/021* (2013.01); *F01P 2003/024* (2013.01); *F01P 2007/146* (2013.01); *F01P 2025/13* (2013.01); *F01P 2025/31* (2013.01); *F01P 2025/32* (2013.01); *F01P 2037/02* (2013.01)

(58) Field of Classification Search

CPC ..... F01P 11/04; F01P 3/02; F01P 7/14; F01P 2003/021; F01P 2003/024; F02F 1/14

See application file for complete search history.

(56) References Cited

U.S. PATENT DOCUMENTS

| | | | | |
|---|---|---|---|---|
| 5,207,188 | A | 5/1993 | Hama et al. | |
| 6,223,702 | B1 * | 5/2001 | Achenbach | F02F 1/10 123/41.71 |
| 2010/0300394 | A1 | 12/2010 | Song et al. | |
| 2014/0209046 | A1 * | 7/2014 | Steiner | F01P 5/10 123/41.31 |
| 2014/0245975 | A1 * | 9/2014 | Quix | F01P 5/10 123/41.08 |

FOREIGN PATENT DOCUMENTS

| | | | |
|---|---|---|---|
| DE | 102009023332 | A1 | 1/2011 |
| WO | 2016008810 | A1 | 1/2016 |

* cited by examiner

*Primary Examiner* — Syed O Hasan

(74) *Attorney, Agent, or Firm* — Greg Brown; McCoy Russell LLP

(57) ABSTRACT

Methods and system are provided for a cooling arrangement of an engine. In one example, the cooling arrangement may include first and second cooling ducts, where the second cooling ducts are arranged in gaps formed between adjacent cylinders and the first ducts are arranged outside of the gaps of the adjacent cylinders.

18 Claims, 5 Drawing Sheets

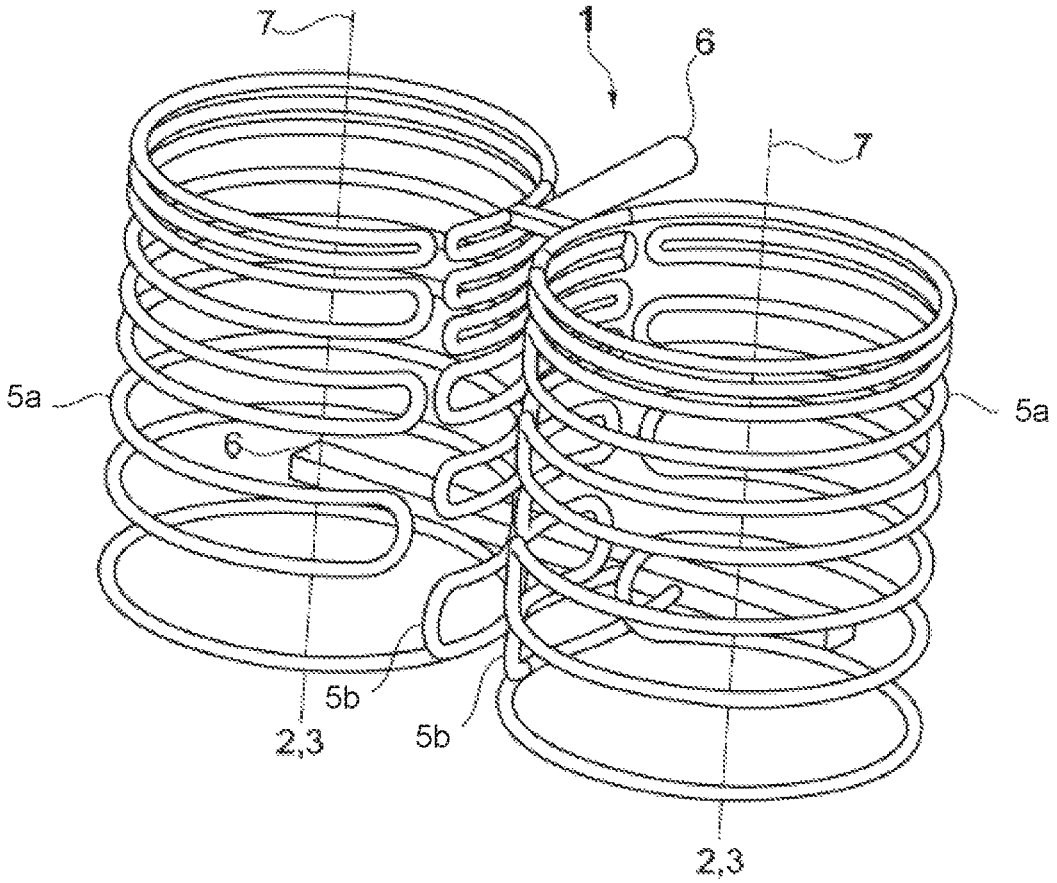
FIG. 1
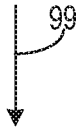

LIQUID-COOLED INTERNAL COMBUSTION ENGINE COMPRISING A CYLINDER BLOCK, AND METHOD FOR PRODUCING AN ASSOCIATED CYLINDER BLOCK

CROSS REFERENCE TO RELATED APPLICATION

The present application claims priority to German Patent Application No. 102016222184.1, filed on Nov. 11, 2016. The entire contents of the above-referenced application are hereby incorporated by reference in its entirety for all purposes.

FIELD

The present description relates generally to methods and systems for a cooling arrangement for two or more cylinders of an engine and for producing a cylinder block of the engine.

BACKGROUND/SUMMARY

An internal combustion engine may be used as a drive for motor vehicles. Within the context of the present disclosure, the expression "internal combustion engine" encompasses Otto-cycle engines and diesel engines but also hybrid internal combustion engines, which utilize a hybrid combustion process, and hybrid drives which comprise not only the internal combustion engine but also an electric machine which is connectable in terms of drive to the internal combustion engine and which receives power from the internal combustion engine or which, as a switchable auxiliary drive, outputs power in addition.

Internal combustion engines have a cylinder block and at least one cylinder head which are connectable to one another or connected to one another in order to form the individual cylinders, that is to say combustion chambers. The individual components will be discussed briefly below.

The cylinder head may hold the control elements, and in the case of an overhead camshaft, to hold the valve drives in their entirety. During the charge exchange, the combustion gases are discharged via the at least one outlet opening and the charging of the combustion chamber takes place via the at least one inlet opening of the at least one cylinder. To control the charge exchange, in four-stroke engines, use is made almost exclusively of lifting valves as control elements, which lifting valves perform an oscillating lifting movement during the operation of the internal combustion engine and which lifting valves open and close the inlet opening and outlet opening in this way. The valve actuating mechanism used for the movement of a valve, including the valve itself, is referred to as the valve drive.

In applied-ignition internal combustion engines, an ignition device may also be arranged in the cylinder head, and furthermore in the case of direct-injection internal combustion engines, the injection device may be arranged in the cylinder head. To form a functional connection, which seals off the combustion chambers, between the cylinder head and the cylinder block, an adequately large number of adequately large bores may be provided.

To hold the pistons or the cylinder liners, the cylinder block has a corresponding number of cylinder bores. The piston of each cylinder of an internal combustion engine is guided in an axially movable manner along the cylinder longitudinal axis in a cylinder barrel and, together with the cylinder barrel and the cylinder head, delimits the combustion chamber of a cylinder. Here, the piston crown forms a part of the combustion chamber inner wall, and, together with the piston rings, seals off the combustion chamber with respect to the cylinder block or the crankcase, such that substantially no combustion gases or no combustion air pass(es) into the crankcase, and substantially no oil passes into the combustion chamber.

The pistons serve to transmit the gas forces generated by the combustion to the crankshaft. For this purpose, each piston is articulatedly connected by means of a piston pin to a connecting rod, which in turn is movably mounted on the crankshaft.

The crankshaft which is mounted in the crankcase absorbs the connecting rod forces, which are composed of the gas forces as a result of the fuel combustion in the combustion chamber and the inertia forces as a result of the non-uniform movement of the engine parts. Here, the reciprocating movement of the pistons is transformed into a rotating rotational movement of the crankshaft. The crankshaft transmits the torque to the drivetrain. A part of the energy transmitted to the crankshaft is used for driving auxiliary units such as the oil pump and the alternator, or serves for driving the camshaft and therefore for actuating the valve drives.

Generally, and within the context of the present disclosure, the upper crankcase half is formed by the cylinder block. The crankcase is generally complemented by the lower crankcase half which can be mounted on the upper crankcase half and which serves as an oil pan.

The cylinder block of an internal combustion engine is a thermally and mechanically highly loaded component, wherein the demands on the cylinder block increase. In this context, it may be taken into consideration that internal combustion engines may be supercharged—by means of exhaust-gas turbocharger or mechanical supercharger—in order to lower fuel consumption, that is to say improve efficiency. As a result, it is in particular the case that the thermal load on the internal combustion engine and on the cylinder block increases, such that increased demands may be placed on the cooling arrangement, and measures may be implemented which reliably prevent thermal overloading of the internal combustion engine.

It is fundamentally possible for the engine cooling arrangement to take the form of an air-type cooling arrangement or a liquid-type cooling arrangement. In the case of the air-type cooling arrangement, the internal combustion engine is provided with a fan, wherein the dissipation of heat takes place by means of an air flow conducted over the surface of the cylinder head and of the cylinder block.

On account of the higher heat capacity of liquids in relation to air, it is possible for significantly greater quantities of heat to be dissipated using a liquid-type cooling arrangement than is possible using an air-type cooling arrangement. For this reason, internal combustion engines may be equipped with a liquid-type cooling arrangement.

The internal combustion engine to which the present disclosure relates also has a liquid-type cooling arrangement, wherein at least the cylinder block is equipped with a liquid-type cooling arrangement.

A liquid-type cooling arrangement demands that the internal combustion engine or the cylinder block be equipped with at least one integrated coolant jacket, which conducts the coolant through the cylinder block. The heat which is released to the coolant is extracted from the coolant again for example in a heat exchanger, which may be arranged in the front-end region of the vehicle.

The heat may not initially be conducted to the block surface in order to be dissipated, as is the case in an air-type cooling arrangement, but rather is discharged to the coolant already in the interior of the cylinder block. Here, the coolant may be delivered by means of a pump arranged in the coolant circuit, such that said coolant circulates. The heat which is discharged to the coolant is thereby discharged from the interior of the cylinder block, and is extracted from the coolant again outside the cylinder block, for example by means of a heat exchanger and/or in some other way.

A coolant may comprise a water-glycol mixture provided with additives. In relation to other coolants, water may be non-toxic, readily available, and cheap, and furthermore has a high heat capacity, for which reason water is suitable for the extraction and dissipation of large amounts of heat.

Like the cylinder block, the cylinder head may also be equipped with one or more coolant jackets. The cylinder head is generally the thermally more highly loaded component because, by contrast to the cylinder block, the head is provided with exhaust-gas-conducting lines, and the combustion chamber walls which are integrated in the head are exposed to hot exhaust gas for longer than the cylinder barrels provided in the cylinder block. Furthermore, the cylinder head has a lower component mass than the block.

Equipping the cylinder block with a liquid-type cooling arrangement and at least one coolant jacket has the effect, in an internal combustion engine according to previous examples, that large temperature gradients arise in the block during operation, in particular in a web region, that is to say in the region between two adjacent cylinders, which may also referred to as bore bridge. This is also owing to the fact that the cooling arrangement according to the previous examples is designed not in accordance with demand but rather with regard to the method of production of the cylinder block, which is generally produced in a casting process, whereby the arrangement and shaping of the coolant jackets is heavily influenced and limited. That is to say, a manufacturing process (e.g., the casting process) currently implemented by those skilled in the art may limit cooling in the web region due to the cooling arrangement not being sufficiently incorporated into the web region.

The large temperature differences in the cylinder block may result in greater or lesser thermal distortion of the cylinder barrel of a cylinder. This so-called bore distortion has numerous disadvantageous effects in practice.

According to previous examples, to reduce the bore distortion, slots and/or relatively small bores are formed in the web region by cutting machining of the cylinder block. This measure however leads only to a slight improvement, because it is not possible to machine the entire region between two adjacent cylinders. Furthermore, the highly loaded block is weakened in terms of its strength and durability. As such, these slots do not solve the bore distortion described above.

In order that the piston in interaction with the cylinder barrel and the piston rings can seal off the combustion chamber with respect to the crankcase in an effective manner despite bore distortion, the preload forces of the rings are, according to the previous examples, increased, though this disadvantageously likewise increases the friction or friction losses of the internal combustion engine.

It is sought to minimize the friction losses of an internal combustion engine in order to reduce the fuel consumption and thus also the pollutant emissions.

The inventors have found a solution to at least partially solve the problems described above. In one example, the issues described above may be addressed by a liquid-cooled internal combustion engine having at least one cylinder head with at least one cylinder, at least one cylinder block, which is connected to the at least one cylinder head and which serves as an upper crankcase half, for accommodating at least one piston, each cylinder comprising a combustion chamber which is formed jointly by the cylinder-specific piston, by a cylinder barrel and by the at least one cylinder head, the piston being displaceable in translational fashion along a cylinder longitudinal axis, and the cylinder block being equipped with a liquid-type cooling arrangement. The internal combustion engine further comprising where the cylinder block is equipped with at least one integrated coolant duct for forming a liquid-type cooling arrangement, at least one coolant duct meandering so as to form loops along the cylinder longitudinal axis and at a distance from the cylinder barrel, and the density of the loops increasing in the direction of the at least one cylinder head.

By contrast to the previous examples, the cylinder block of an internal combustion engine according to the disclosure does not have a large-area coolant jacket which covers or surrounds the at least one cylinder barrel at least in regions and which promotes production by means of casting.

Rather, to form the liquid-type cooling arrangement, at least one coolant duct may be provided or integrated in the cylinder block. Here, at least one coolant duct may be led around a cylinder barrel, specifically such that said duct meanders so as to form loops along the cylinder longitudinal axis (e.g., axis about which the piston oscillates) and at a distance from the cylinder barrel. The duct loops around the cylinder barrel over an angle $\gamma$. This production of the liquid-type cooling arrangement, in which ducts can be led through the cylinder block in accordance with the actual cooling demand, is made possible by producing the block using an additive manufacturing process, in the case of which the cylinder block is built up in layered fashion.

Consequently, allowance can also be made for the fact that a cylinder block is thermally particularly highly loaded in the web region, and the thermal loading basically increases in the direction of the cylinder head, that is to say increases along the cylinder longitudinal axis toward the cylinder head.

According to the disclosure, therefore, it is also the case that the density of the loops increases in the direction of the at least one cylinder head. In the context of the present disclosure, a loop refers to a duct section which comprises two limbs and an intermediate piece connecting said two limbs, wherein the limbs generally run transversely with respect to the cylinder longitudinal axis, and the intermediate piece generally runs parallel to the cylinder longitudinal axis. For the coolant, there is thus a resulting main delivery direction along the cylinder longitudinal axis, toward the cylinder head or away from the cylinder head. Additionally or alternatively, density of loops may refer to one or more of a number of loops and a volume of the loops.

If the density of the loops increases, this means that the number of loops or the number of duct sections, which form the loops, per unit of distance increases in the direction of the cylinder longitudinal axis. With increasing density of the loops, the limb-like duct sections are at a smaller distance from one another, whereby the cooling power likewise increases.

The internal combustion engine according to the disclosure achieves at least a partial solution to the issues described above, specifically that of providing a liquid-cooled internal combustion engine which is improved with regard to the thermally induced bore distortion in the cylinder block.

Embodiments of the liquid-cooled internal combustion engine may comprise at least one coolant duct meanders so as to form U-shaped loops along the cylinder longitudinal axis and at a distance from the cylinder barrel.

The U-shaped design of the loops makes allowance for the fact that, according to the disclosure, a loop comprises two limbs and an intermediate piece connecting said two limbs. The limbs preferably run transversely with respect to the cylinder longitudinal axis, and the intermediate piece may extend parallel to the cylinder longitudinal axis.

Embodiments of the liquid-cooled internal combustion engine may comprise at least one coolant duct meanders so as to form loops along the cylinder longitudinal axis and at a distance from the cylinder barrel and, in so doing, loops around the cylinder barrel over an angle $\gamma$.

In configuring the magnitude of the loop angle $\gamma$, it is necessary to take into consideration the aim that it is sought to achieve by means of the liquid-type cooling arrangement, in particular also which region of the cylinder block a duct is arranged in and what possibilities are afforded by said region or what conditions are demanded of the cooling arrangement by the thermal load in said region.

In this context, embodiments of the liquid-cooled internal combustion engine may be comprise in which, for the angle $\gamma$, the following applies: $\gamma \leq 360°$. In this embodiment, a duct may loop around the cylinder barrel in its entirety, that is to say over its full circumference.

In this context, embodiments of the liquid-cooled internal combustion engine may also comprise in which, for the angle $\gamma$, the following applies: $\gamma \leq 270°$. This embodiment may be suitable for example for an outer cylinder of an in-line engine, wherein the duct is arranged or runs predominantly on the side averted from the adjacent inner cylinder.

In this context, embodiments of the liquid-cooled internal combustion engine may likewise comprise in which, for the angle $\gamma$, the following applies: $\gamma \leq 180°$. This embodiment may be suitable for example for an inner cylinder of an in-line engine, wherein the duct is arranged or runs between the two bore bridges with the adjacent cylinders. The same also applies to the following embodiment.

Specifically, in this context, embodiments of the liquid-cooled internal combustion engine may also comprise in which, for the angle $\gamma$, the following applies: $\gamma \leq 90°$. This embodiment may furthermore also be suitable for the cooling of a bore bridge, that is to say for the cooling of the region between adjacent cylinders, which is thermally particularly highly loaded and therefore also has the greatest cooling demand. The same also applies to the following embodiment.

In this context, embodiments of the liquid-cooled internal combustion engine may comprise in which, for the angle $\gamma$, the following applies: $\gamma \leq 60°$. This embodiment may also be suitable for the cooling of the bore bridge between two adjacent cylinders.

In the case of liquid-cooled internal combustion engines having at least one cylinder head with at least two cylinders, embodiments may therefore also comprise in which at least one integrated coolant duct runs and meanders between two adjacent cylinders in the web region.

In this context, embodiments of the liquid-cooled internal combustion engine may comprise in which two integrated coolant ducts run and meander between two adjacent cylinders in the web region.

Embodiments of the liquid-cooled internal combustion engine may comprise in which the cylinder block is equipped with at least two integrated coolant ducts for forming a liquid-type cooling arrangement. Then, a cylinder of a multi-cylinder internal combustion engine may be equipped with two or more coolant ducts, for example one duct which meanders in the web region and has a relatively small loop angle $\gamma$, and one duct which circumferentially loops around the cylinder barrel outside the web region over a relatively large angle $\gamma$.

In this context, embodiments of the liquid-cooled internal combustion engine may comprise in which at least two integrated coolant ducts have a separate, independent coolant supply. This embodiment may acknowledge that different regions of the block have different levels of cooling demand.

A separate, independent coolant supply makes it possible, for example, to realize a higher coolant throughput through a duct which meanders in the web region, and a lower coolant throughput through a duct which loops around the cylinder barrel outside the web region. In addition to a variation of the coolant throughput, it is also possible to realize a different coolant temperature, and possibly to use a different coolant; for example water and oil.

Embodiments of the liquid-cooled internal combustion engine may comprise in which the cylinder barrel of a cylinder is formed as a cylinder bore of the cylinder block.

However, embodiments of the liquid-cooled internal combustion engine may also comprise in which the cylinder barrel of a cylinder is a cylinder liner which is inserted into the cylinder block.

The above embodiments may differ by the fact that the piston is, on the one hand, received and mounted directly in the cylinder block, with a cylinder bore serving for this purpose, and on the other hand, a liner is provided for receiving the piston, wherein said liner is received in the block.

In the context of the present disclosure, the expression "cylinder barrel" is a generic term under which the designations or embodiments "cylinder bore" and "cylinder liner" can be subsumed.

The disclosure further comprises a method, specifically that of specifying a method for producing a cylinder block of an internal combustion engine of a type described above, is achieved by way of a method which is distinguished by the fact that the cylinder block is produced by means of an additive manufacturing method, in which the cylinder block is built up in layered fashion.

That which has already been stated with regard to the internal combustion engine according to the disclosure also applies to the method according to the disclosure.

Embodiments of the method may comprise where the cylinder block is produced at least inter alia by means of 3D printing. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 1 schematically shows, in a perspective illustration, the coolant ducts, integrated in the cylinder block, of two adjacent cylinders of a first embodiment of the internal combustion engine.

DETAILED DESCRIPTION

Figure 2:
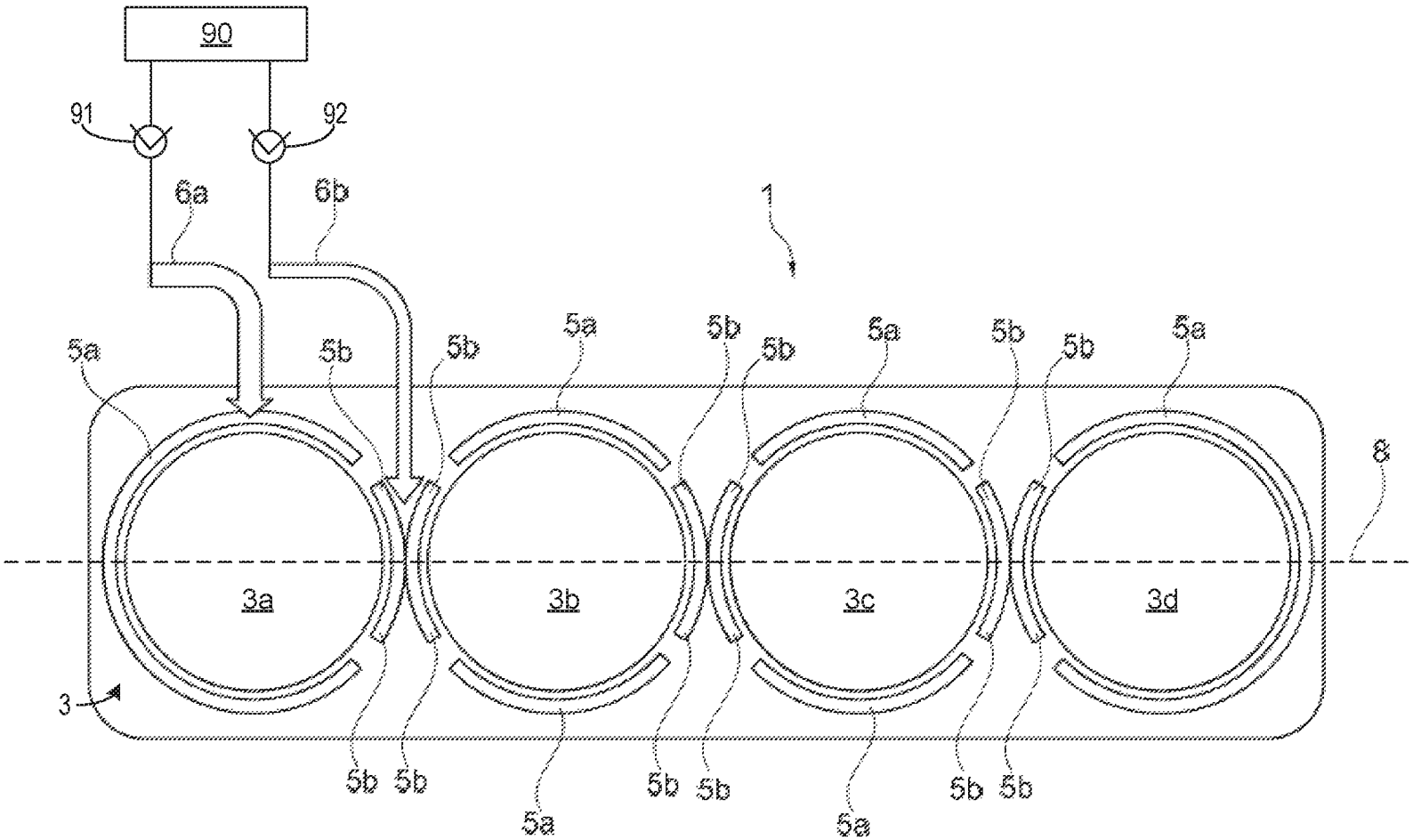
FIG. 2 schematically shows the cylinder block together with coolant ducts of a second embodiment of the internal combustion engine.
Figure 3A:
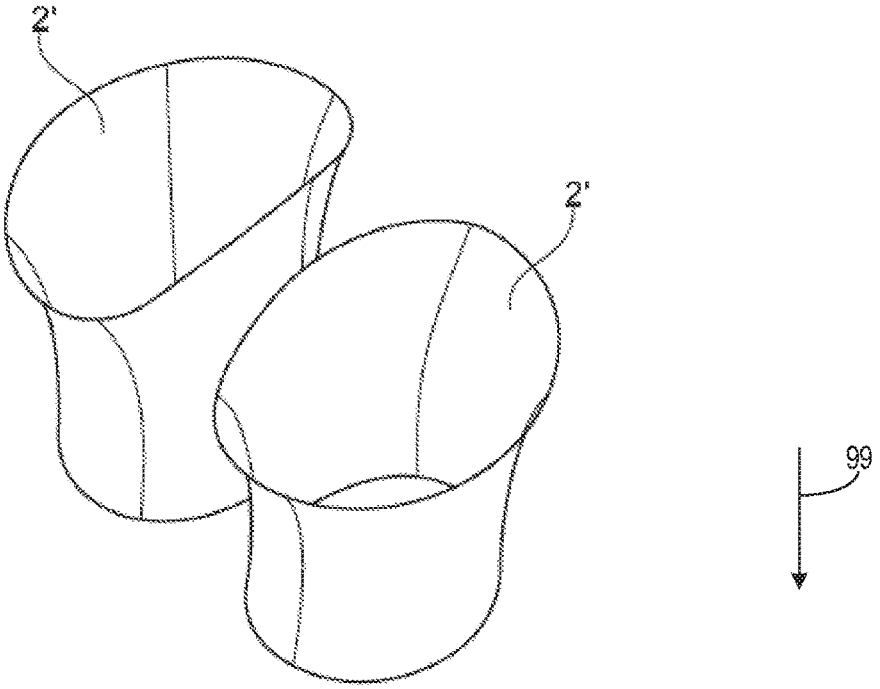
FIG. 3A schematically shows, in a perspective illustration, the cylinder barrels of two adjacent cylinders of an internal combustion engine according to the previous examples which has been heated up to operating temperature.
Figure 3B:
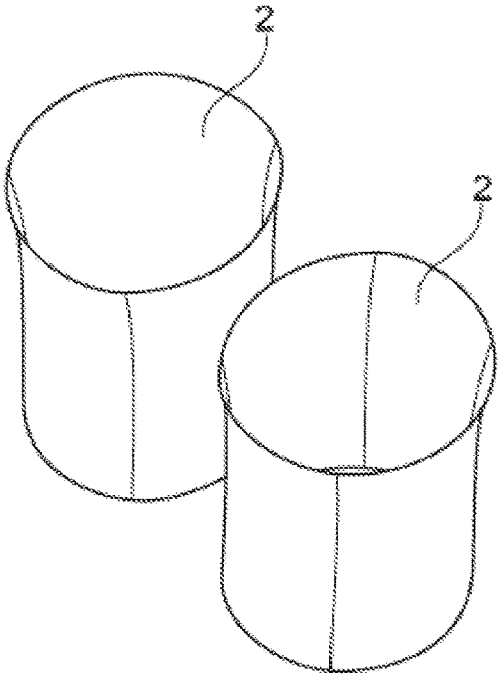
FIG. 3B schematically shows, in a perspective illustration, the cylinder barrels of two adjacent cylinders of an internal combustion engine according to the disclosure which has been heated up to operating temperature.
Figure 4:
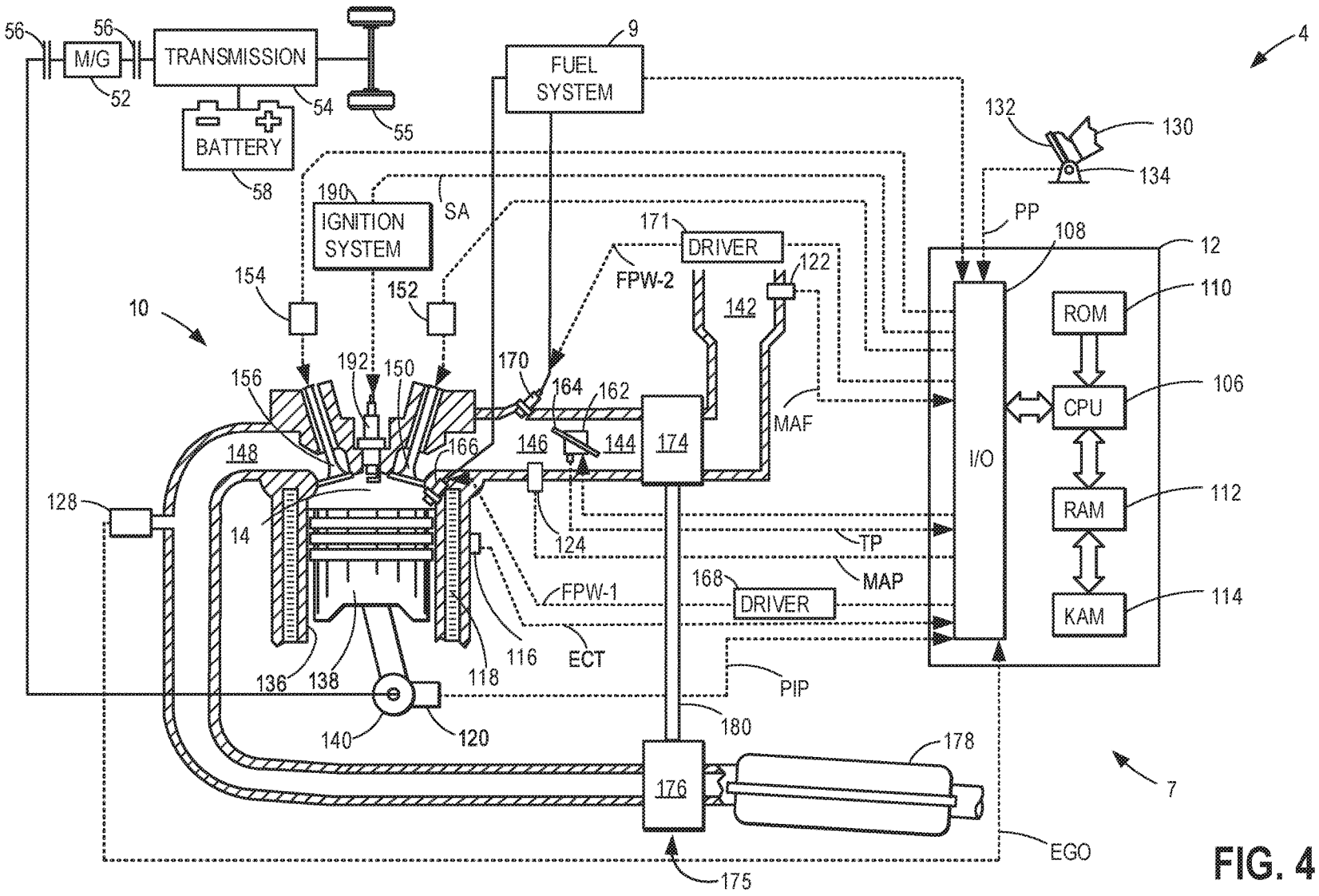
FIG. 4 shows an example of a vehicle system utilizing an engine configured to utilize the cylinders of FIG. 1.
Figure 5:
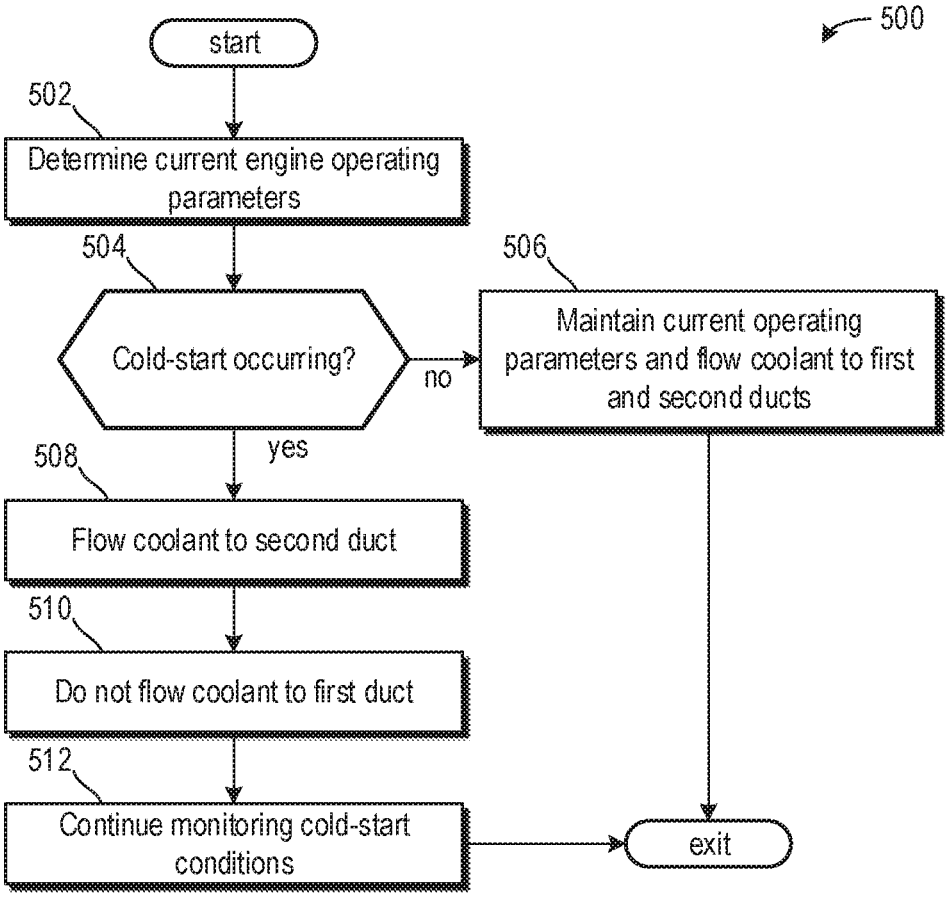
FIG. 5 shows a method for flowing coolant to the coolant ducts.

The following description relates to systems and methods for a cooling arrangement of an engine. FIG. 1 shows a shape of the cooling arrangement, which may include first and second ducts. The ducts may be serpentine or U-shaped. Additionally, a number of loops of the ducts may increase in a direction opposite gravity such that there are a greater number of loops near a portion of a cylinder adjacent the head. The second ducts may be arranged in gaps formed between directly adjacent cylinders, as shown in FIG. 2. The first ducts are arranged outside of the gaps. FIGS. 3A and 3B illustrate a cylinder barrel not having the cooling arrangement described herein and a cylinder barrel having the cooling arrangement described herein, respectively. FIG. 4 illustrates a schematic of an engine having a cylinder configured to include the cooling arrangement. FIG. 5 illustrates a method for adjusting coolant flow to the first and second ducts of the cooling arrangement.

FIG. 1 schematically shows, in a perspective illustration, coolant ducts 5, integrated in a cylinder block 1, of two adjacent cylinders 3 of a first embodiment of an internal combustion engine.

Each cylinder 3 may be equipped with two coolant ducts 5*a* and 5*b*, of which in each case a first duct 5*a* loops around the cylinder barrel 2 outside the web region over a relatively large angle $\gamma$ over approximately the full circumference, and second duct 5 meanders in the web region between the cylinders 3 and has a relatively small loop angle $\gamma$.

Consequently, a total of four coolant ducts is provided, of which the second ducts 5*b* meander between the cylinders 3, that is to say in the web region. The second ducts 5*b* may be connected to one another and are supplied with coolant by means of a common coolant supply 6. The second ducts 5*b*, which run in the web region, of cylinder 3 may branch off from the first duct 5*a*.

In this way, each cylinder of the cylinders 3 comprises at least one of the first duct 5*a* and the second duct 5*b*. The first duct 5*a* and the second duct 5*b* wrap around a circumference of a cylinder of the cylinders 3. The first duct 5*a* may be arranged on a portion of a cylinder distal to the adjacent cylinder. That is to say, the first duct 5*a* is arranged on a portion of the cylinder farther away from the adjacent cylinder than a location of the second duct 5*b*.

The first 5*a* and second 5*b* coolant ducts may meander so as to form loops in each case along the cylinder longitudinal axis 7 and at a distance from the cylinder barrel 2, wherein the density of the loops increases in each case in the direction of the cylinder head (not illustrated), that is to say in the direction opposite gravity (shown by arrow 99). Said another way, an occurrence of the first 5*a* and second 5*b* coolant ducts increases in a direction opposite gravity such that an amount of coolant near an upper portion of the cylinders 3 may be greater than an amount of coolant near a lower portion of the cylinders 3.

The loops may be of U-shaped form. A loop comprises two limb-like duct sections which run transversely with respect to the cylinder longitudinal axis 7 and which are connected to one another via an intermediate piece, wherein the intermediate piece is of semicircular form and bridges a distance parallel to the cylinder longitudinal axis 7. With increasing density of the loops, the limb-like duct sections are at a smaller distance from one another, whereby the cooling power increases. For the coolant, there is a resulting main delivery direction along the cylinder longitudinal axes 7.

Thus, the first and second coolant ducts 5*a*, 5*b* are not a single coolant jacket wrapping around an entire cylinder circumference, in one example. The first and second coolant ducts 5*a*, 5*b* are separate coolant ducts extending around at least a portion of the entire cylinder circumference.

FIG. 2 schematically shows, in a plan view, the cylinder block 1 together with first and second coolant ducts 5*a*, 5*b* of FIG. 1.

Said cylinder block is the cylinder block 1 of a four-cylinder in-line engine, in which the four cylinders 3 are arranged in a line along the longitudinal axis 8 of the cylinder block 1.

The two outer cylinders 3*a* and 3*d* may be equipped in each case with first and second coolant ducts 5*a*, 5*b*, of which in each case the first duct 5*a* loops around the cylinder barrel 2 outside the web region over a relatively large angle $\gamma \approx 270°$ on the side averted from the adjacent inner cylinder 3, and a second duct 5*b* meanders in the web region between the cylinders 3 and has a relatively small loop angle $\gamma \approx 60°$.

The two inner cylinders 3*b* and 3*c* are equipped in each case with four coolant ducts. Two first ducts 5*a* are arranged on both sides of the cylinder 3 between the two bore bridges with the adjacent cylinders 3 and meander outside the web region in each case over an angle $\gamma \approx 95°$. Two second ducts 5*b* meander in each case in the web region, that is to say in the bore bridge of the cylinder 3 with an adjacent cylinder 3, and have a relatively small loop angle $\gamma \approx 60°$.

Two independent coolant supplies 6*a*, 6*b* are provided, wherein the first coolant ducts 5*a* and the second coolant ducts 5*b* are supplied separately with coolant.

This is illustrated by way of example for first cylinder 3*a*. The first ducts 5*a* running outside the web region are supplied with coolant by means of a first coolant supply 6*a*, whereas the second coolant supply 6*b* supplies coolant to the second ducts 5*b* which meander in the web region between the cylinders 3.

Characteristic operating variables of the coolant supply 6*a*, 6*b* such as coolant throughput and coolant temperature can be selected and set in a duct-specific manner and thus also in accordance with demand.

The separate coolant supply 6*a*, 6*b* permits in particular a greater coolant throughput through the second ducts 5*b*, which meander in the thermally highly loaded web region, and a lesser coolant throughput through the first duct 5*a*, which loops around the cylinder 3 outside the web region.

Said another way, the cylinder block 1 comprises four cylinders, a first cylinder 3*a*, a second cylinder 3*b*, a third cylinder 3*c*, and a fourth cylinder 3*d*. The second and third cylinders 3*b*, 3*c* may be arranged between the first and fourth cylinders 3*a*, 3*d*. In one example, the second cylinder 3*b* is directly adjacent to the first cylinder 3*a* and the third cylinder 3*c*. As such, the third cylinder 3*c* is directly adjacent to the second cylinder 3*b* and the fourth cylinder 3*d*.

As shown, the first cylinder 3*a* is directly adjacent to only the second cylinder 3*b*. As such, the first ducts 5*a*, which extend around an outer portion of the first cylinder 3*a*, away from the second cylinder 3*b*, may extend around a majority of the circumference of the first cylinder 3*a*. The first ducts 5*a* may extend around 70 to 80% of the first cylinder 3*a*. In one example, the first duct of the first ducts 5*a* of the first cylinder 3*a* extends around exactly 75% of the circumference of the first cylinder 3*a*. The first duct of the first cylinder may not come into contact with any other ducts (e.g., other first ducts 5*a* or second ducts 5*b*. As shown, the second duct of the first cylinder 3*a* is arranged on a portion of the first cylinder 3*a* closest to the second cylinder 3*b*. The second duct of the second ducts 5*b* of the first cylinder 3*a* may extend around only 20-30% of the circumference of the first cylinder 3*a*. In one example, the second duct of the first cylinder 3*a* extends around exactly 25% of the circumference of the first cylinder 3*a*. The second duct 5*b* may be in face-sharing contact with a second duct 5*b* of the second cylinder 3*b*. The first and second ducts of the fourth cylinder 3*d* may be arranged in similarly to the first and second ducts of the first cylinder. Thus, description of the first and second ducts of the first cylinder 3*a* may be applied to the first and second ducts of the fourth cylinder 3*d*.

The second cylinder 3*b* may comprise two of the second ducts 5*b*. In one example, a first second duct of the second ducts 5*b* of the second cylinder 3*b* may be in face-sharing contact with the second duct of the first cylinder 3*a*. Additionally, a second second duct of the second cylinder 3*b* may be in face sharing contact with a second duct of third cylinder 3*c*. The second cylinder may further comprise two first ducts of the first ducts 5*a*, wherein the first ducts of the second cylinder 3*b* are separated and arranged between second ducts 5*b* of the second cylinder 3*b*. In this way, the first ducts and second ducts 5*a*, 5*b* of the second cylinder 3*b* alternate. In one example, each of the first ducts and second ducts extends around 25% of the circumference of the second cylinder.

The third cylinder 3*c* may be substantially similar to the second cylinder 3*b*, where the third cylinder comprises alternating iterations of the first and second ducts 5*a*, 5*b*.

By arranging the second duct 5*b* in locations of the cylinder 3 closest to one another (e.g., the web region), cooling of the cylinders 3 may be improved relative to previous examples described above (e.g., slots in the web region). Additionally, this cooling effect may be further increased by allowing the first ducts 5*a* to receive coolant supply 6*a* and the second ducts 5*b* to receive coolant supply 6*b*. As such, coolant flow to the first and second ducts 5*a*, 5*b* may be independently adjusted. In one example, coolant may flow to only the second ducts 5*b* and not to the first ducts 5*a* during some engine operating conditions.

In some examples, each first duct of the first ducts 5*a* may be fluidly coupled to one another. In this way, coolant in the first duct of the first cylinder 3*a* may flow to the first duct of the third cylinder 3*c*. Additionally or alternatively, a first duct of a cylinder may be fluidly sealed from first ducts 5*a* of other cylinders. As such, the first duct of the first cylinder 3*a* may not fluidly communicate with the first duct of the fourth cylinder 3*d*.

Additionally or alternatively, the second ducts 5*b* may be fluidly coupled to one another. In one example, only second ducts 5*b* which closest to one another may be fluidly coupled to one another. In other examples, the each of the second ducts 5*b* may be fluidly sealed from other second ducts 5*b*.

Coolant supplies 6*a* and 6*b* may be from the same coolant system. Alternatively, the coolant supplies may be from separate coolant systems. The separate coolant systems may utilize a shared degas bottle. One or more valves may be arranged between the coolant systems and the first and second ducts 5*a*, 5*b* to adjust the flow of coolant thereto.

Specifically, a coolant system 90 is shown, which may supply coolant supplies 6*a* and 6*b* to the first ducts 5*a* and the second ducts 5*b*, respectively. Coolant supply 6*a* to the first ducts 5*a* may be adjusted based on a position of a first valve 91. Similarly, coolant supply 6*b* to the second ducts 5*b* may be adjusted based on a position of a second valve 92. In one example, the first 91 and second 92 valves are substantially identical. The first 91 and second 92 valves may be pneumatically, electrically, hydraulically, and/or mechanically powered. The first 91 and second 92 valves may be adjusted to a fully open position, a fully closed position, or any position therebetween. The fully open position may allow 100% fluid flow through the valve. Conversely, the fully closed position may prevent fluid flow through the valve. As such, the fully closed position allows 0% flow through the valve. The positions therebetween may allow coolant flows between 0 and 100%. In this way, an amount of coolant flowing to either the first ducts 5*a* or the second ducts 5*b* may be individually adjusted. By doing this, coolant flow to the first ducts 5*a* may be stopped while coolant continues to flow to the second ducts 5*b*.

In some examples, additionally or alternatively, a number of first 91 and second valves 92 may be equal to a number of first and second ducts 5*a*, 5*b*. As such, each of the first ducts 5*a* and second ducts 5*b* may comprise one of the first valve 91 or the second valve 92, respectively, to adjust coolant flow thereto. In this way, only some of the first ducts 5*a* may receive coolant while remaining first ducts 5*a* may not receive coolant. Additionally or alternatively, some of the first ducts 5*a* may receive more coolant than other of the first ducts 5*a*. For example, first ducts 5*a* of the second and third cylinders 3*b*, 3*c* may receive more coolant during some engine operating conditions than first ducts of the first and fourth cylinder 3*a*, 3*d*.

FIG. 3A schematically shows, in a perspective illustration, the cylinder barrels 2' of two adjacent cylinders of an internal combustion engine according to previous examples which has been heated up to operating temperature. Said another way, the cylinder barrels 2' do not comprise the first 5*a* and second 5*b* ducts of FIGS. 1 and 2.

A thermal bore distortion of the cylinder barrels 2', which increases in the direction of the cylinder head, that is to say in the upward direction opposite gravity 99, and impedes effective sealing of the combustion chambers or necessitates high preload forces for the piston rings. Additionally or alternatively, the degradation (e.g., the thermal bore distortion) may alter a compression ratio of the cylinders corresponding to the cylinder barrels 2', thereby adjusting knock limits and combustion stability limits for those cylinders.

FIG. 3B schematically shows, in a perspective illustration, the cylinder barrels 2 (e.g., cylinder barrels 2 of FIG. 1) of two adjacent cylinders of an internal combustion engine according to the disclosure which has been heated up to operating temperature. As such, the cylinder barrels 2 may comprise the first 5*a* and second 5*b* ducts of FIGS. 1 and 2.

The embodiment according to the disclosure of the liquid-type cooling arrangement with coolant ducts which meander so as to form loops along the cylinder longitudinal axis and at a distance from the cylinder barrel 2, and the density of which increases in the direction of the cylinder head, significantly reduces the thermal bore distortion of the cylinder barrels 2.

FIG. 4 depicts an example of a cylinder of internal combustion engine 10 included by engine system 7 of vehicle 4. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 (which may be referred to herein as a combustion chamber) of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. FIG. 4 shows engine 10 configured with a turbocharger 175 including a compressor 174 arranged between intake passages 142 and 144, and an exhaust turbine 176 arranged along exhaust passage 148. Compressor 174 may be at least partially powered by exhaust turbine 176 via a shaft 180. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 4, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 9. Fuel system 9 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 4 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 9 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port fuel injection (hereafter referred to as "PFI") into the intake port upstream of cylinder 14. Fuel injector 170 may inject fuel, received from fuel system 9, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 9 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

Controller 12 is shown in FIG. 4 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature.

In one example, the cooling sleeve 118 is similar to the first and/or second ducts 5*a*, 5*b* of FIGS. 1 and 2. As such, the cooling sleeve 118 may wrap around the cylinder walls 136, wherein an occurrence and/or volume of the cooling sleeve 118 increases toward an upper portion of the cylinder 14. In one example, the upper portion of the cylinder 14 is adjacent to the fuel injector 166 and spark plug 192.

As described above, FIG. 4 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 4 with reference to cylinder 14.

In some examples, vehicle 4 may be a hybrid vehicle with multiple sources of torque available to one or more vehicle wheels 55. In other examples, vehicle 4 is a conventional vehicle with only an engine. In the example shown, vehicle 4 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

Turning now to FIG. 5, it shows a method 500 for operating first and second ducts of a cooling arrangement during a cold-start. Instructions for carrying out method 500 may be executed by a controller based on instructions stored on a memory of the controller and in conjunction with signals received from sensors of the engine system, such as the sensors described above with reference to FIG. 4. The controller may employ engine actuators of the engine system to adjust engine operation, according to the methods described below.

The method 500 begins at 502, where the method 500 may include determining, estimating, and/or measuring current engine operating parameters. Current engine operating parameters may include, but are not limited to, one or more of throttle position, engine temperature, engine speed, manifold pressure, vehicle speed, exhaust gas recirculation flow rate, and air/fuel ratio.

At 504, the method 500 may include determining if a cold-start is occurring. The cold-start may be based on an engine temperature, wherein the cold-start is occurring if the engine temperature is less than an ambient temperature. Additionally or alternatively, a cold-start may be occurring if the engine temperature is less than a desired engine operating temperature (e.g., 185-205° F.). In one example, the engine temperature may be determined via a temperature sensor (e.g., temperature sensor 116 of FIG. 4).

If the cold-start is not occurring, then the method may proceed to 506 to maintain current operating parameters and flow coolant to the first and second ducts. That is to say, coolant may flow to the web region between adjacent cylinders (e.g., the second duct) and to portions of the cylinders spaced away from other cylinders (e.g., the first duct). As such, coolant from the coolant system may flow through at least partially open first and second valves to flow coolant to both the first and second ducts. The coolant system, first valve, second valve, first duct, and second duct may be substantially similar to the coolant system 90, first valve 91, second valve 92, first duct 5*a*, and second duct 5*b* of FIG. 2.

If the cold-start is occurring, then the method may proceed to 508 to flow coolant to the second duct. Flowing coolant to the second duct may include at least partially opening the second valve arranged between the coolant system and the second duct. As described above, by flowing coolant to one of the second ducts of one of the cylinders may result in coolant flowing from the one second duct to the remainder of the second ducts. Additionally or alternatively, each second duct may comprise a valve, similar to the second valve, arranged between it and the coolant system such that coolant flow to each of the second ducts may be adjusted individually, thereby allowing coolant to flow to some of the second ducts and not all of the second ducts for some positions of the valves.

At 510, the method 500 may include not flowing coolant to the first duct. This may include fully closed a first valve arranged between the first ducts and the coolant system (e.g., first valve 91 and coolant system 90 of FIG. 2). As such, outer portions of the cylinders may not receive coolant and only the web region (e.g., area associated with the second ducts) may receive coolant. By flowing coolant to only the second ducts, the coolant temperature may increase to a threshold temperature more quickly than by flowing coolant to each of the first and second ducts. In one example, the threshold temperature is a temperature greater than ambient. Additionally or alternatively, the threshold temperature may be substantially equal to a desired engine operating temperature.

At 512, the method may continue to monitor cold-start conditions. If the cold-start is not complete, then the method may continue flowing coolant to only the second duct. If the cold-start is complete, then the method may begin to flow coolant to both the first and second ducts.

In this way, the cooling arrangement comprising the first and second ducts described above may provide increased cooling to cylinders of an engine. Additionally or alternatively, coolant may be selectively delivered to only the second ducts during a cold-start to decrease cold-start times. The technical effect of arranging the second ducts in gaps between directly adjacent cylinders is to provide increased cooling during engine operating conditions outside of the cold-start and to decrease cold-start times by rapidly heating the coolant in the second ducts. By doing this, cylinder degradation may be mitigated and emissions during the cold-start may be reduced.

A liquid-cooled internal combustion engine comprising at least one cylinder head comprising at least one cylinder, at least one cylinder block, which is connected to the at least one cylinder head and which serves as an upper crankcase half, for accommodating at least one piston, the at least one cylinder comprises a combustion chamber which is formed jointly by the at least one piston, by a cylinder barrel, and by the at least one cylinder head, the piston being displaceable in translational fashion along a cylinder longitudinal axis, and the cylinder block is equipped with a liquid-type cooling arrangement, wherein the cylinder block is equipped with a first coolant duct and a second coolant duct, the first and second coolant ducts forming a liquid-type cooling arrangement, the first and second coolant ducts meandering so as to form loops along the cylinder longitudinal axis at a distance from the cylinder barrel, and where a density of the loops increases toward the at least one cylinder head, and where the first and second coolant ducts are fluidly coupled to a coolant system via first and second valves, respectively, the first and second valves being configured to adjust coolant flow to the first and second coolant ducts individually. A first example of the engine further includes where the first and second coolant ducts are U-shaped. A second example of the engine, optionally including the first example, further includes where the first and second coolant ducts form loops along the cylinder longitudinal axis over an angle $\gamma$. A third example of the engine, optionally including the first and/or second examples, further includes where for the angle $\gamma$, the following applies: $\gamma \leq 270°$. A fourth example of the engine, optionally including one or more of the first through third examples, further includes where the at least one cylinder is a first cylinder, the cylinder head further comprising a second cylinder adjacent to the first cylinder, where each of the first and second cylinders comprise at least one of the first ducts and one of the second ducts, and where the second duct of the first cylinder is next to the second duct of the second cylinder. A fifth example of the engine, optionally including one or more of the first through fourth examples, further includes where the first duct of the first cylinder is distal to the first duct of the second cylinder. A sixth example of the engine, optionally including one or more of the first through fifth examples, further includes where comprising a controller with instructions stored on non-transitory memory thereon that when executed enable the controller to selectively flow coolant to only the second duct in response to an engine cold-start. A seventh example of the engine, optionally including one or more of the first through sixth examples, further includes where the cylinder barrel of the at least one cylinder is formed as a cylinder bore of the cylinder block. An eighth example of the engine, optionally including one or more of the first through third examples, further includes where the cylinder barrel of the at least one cylinder is a cylinder liner which is inserted into the cylinder block.

A system comprising an engine having a plurality of cylinders, each of the cylinders comprising at least one first duct of a plurality of first ducts and at least one second duct of a plurality of second ducts, the first ducts being fluidly separated from the second ducts, and where each of the second ducts is arranged in regions of the engine between each of the cylinders and a coolant system fluidly coupled to each of the first ducts and the second ducts, the coolant system configured to adjust coolant flow to the first ducts and the second ducts individually via first and second valves. A first example of the system further includes where first ducts are spaced away from the second ducts. A second example, optionally including the first example, further includes where a controller with computer-readable instructions stored on non-transitory memory thereof that when executed enable the controller to flow coolant to only the second ducts of the cylinders when an engine temperature is less than an ambient temperature by moving the first valve to a fully closed position and adjusting the second valve to an at least partially open position. A third example, optionally including the first and/or second examples, further includes where the second ducts are arranged on portions of the cylinders directly next to one another, where the second ducts of cylinders directly next to one another are in face-sharing contact. A fourth example, optionally including one or more of the first through third examples, further includes where the first ducts are arranged on portions of the cylinder distal to one another, where a first duct of a cylinder of the plurality of cylinders does not touch first ducts or second ducts of the cylinders of the plurality of cylinders. A fifth example, optionally including one or more of the first through fourth examples, further includes where there are exactly four cylinders in the plurality of cylinders, and where the four cylinders are arranged in a line comprising a first outer cylinder directly next to a second inner cylinder, the second inner cylinder being directly next to a third inner cylinder, and a fourth outer cylinder being directly next to the third inner cylinder, and where the first outer cylinder and the fourth outer cylinder comprise second ducts arranged directly between them and the second inner cylinder and the third inner cylinder, respectively, and where the second inner cylinder and the third inner cylinder comprise second ducts arranged therebetween and between them and the first outer cylinder and the fourth outer cylinder, respectively. A sixth example, optionally including one or more of the first through fifth examples, further includes where the first ducts extend around a first amount of the circumference of a cylinder of the plurality of cylinder and where the second ducts extend around a second amount of the circumference of a cylinder of the plurality of cylinders, and where the first amount is greater than or equal to the second amount. A seventh example, optionally including one or more of the first through sixth examples, further includes where regions between each of the cylinder includes a gap, and where the second ducts are arranged in the gap and where the first ducts are arranged outside the gap.

A method comprising adjusting positions of first and second valves in response to a cold-start, the first and second valves fluidly coupling first ducts and second ducts to a coolant system, respectively and flowing coolant to only second ducts of a plurality of cylinders comprising first ducts and second ducts during a cold-start, where the second ducts are arranged in gaps formed directly adjacent cylinders of the plurality of cylinders. A first example of the method further includes where the adjusting includes closing the first valve and at least partially opening the second valve, and where the first ducts are arranged outside of the gaps. A second example of the method, optionally including the first example, further includes where flowing coolant to both the first and second ducts outside of the cold-start, where flowing coolant to both the first and second ducts includes at least partially opening both the first and second valves.

FIGS. 1-3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A liquid-cooled internal combustion engine having: at least one cylinder head comprising at least one cylinder; at least one cylinder block, which is connected to the at least one cylinder head and which serves as an upper crankcase half, for accommodating at least one piston; the at least one cylinder comprises a combustion chamber which is formed jointly by the at least one piston, by a cylinder barrel, and by the at least one cylinder head, the piston being displaceable in translational fashion along a cylinder longitudinal axis; and the cylinder block is equipped with a liquid-type cooling arrangement, wherein the cylinder block is equipped with a first coolant duct and a second coolant duct, the first and second coolant ducts forming a liquid-type cooling arrangement, the first and second coolant ducts meandering so as to form loops along the cylinder longitudinal axis at a distance from the cylinder barrel, and where a density of the loops increases toward the at least one cylinder head, and where the first and second coolant ducts are fluidly coupled to a coolant system via first and second valves, respectively, the first and second valves being configured to adjust coolant flow to the first and second coolant ducts individually, wherein the at least one cylinder is a first cylinder, the cylinder head further comprising a second cylinder adjacent to the first cylinder, where each of the first and second cylinders comprise at least one of the first ducts and one of the second ducts, and where the second duct of the first cylinder is next to the second duct of the second cylinder in web between the two adjacent cylinders.

2. The liquid-cooled internal combustion engine of claim 1, wherein the first and second coolant ducts are U-shaped.

3. The liquid-cooled internal combustion engine of claim 1, wherein the first and second coolant ducts form loops along the cylinder longitudinal axis over an angle $\gamma$.

4. The liquid-cooled internal combustion engine of claim 3, wherein, for the angle $\gamma$, the following applies: $\gamma \leq 270°$.

5. The liquid-cooled internal combustion engine of claim 1, wherein the first duct of the first cylinder is distal to the first duct of the second cylinder.

6. The liquid-cooled internal combustion engine of claim 1, further comprising a controller with instructions stored on non-transitory memory thereon that when executed enable the controller to:

selectively flow coolant to only the second duct in response to an engine cold-start.

7. The liquid-cooled internal combustion engine of claim 1, wherein the cylinder barrel of the at least one cylinder is formed as a cylinder bore of the cylinder block.

8. The liquid-cooled internal combustion engine of claim 1, wherein the cylinder barrel of the at least one cylinder is a cylinder liner which is inserted into the cylinder block.

9. A system comprising: an engine block having a plurality of cylinders, each comprising at least one first duct of a plurality of first ducts in the block and at least one second duct of a plurality of second ducts in the block, the first ducts being fluidly separated from the second ducts so that coolant from the first ducts does not flow or mix with coolant in the second ducts, and where each of the second ducts is arranged in regions of the engine between each of the cylinders; and a coolant system fluidly coupled to each of the first ducts and the second ducts, the coolant system configured to adjust coolant flow to the first ducts and the second ducts individually via first and second valves, wherein the second ducts are arranged on portions of the cylinders directly next to one another, where the second ducts of cylinders directly next to one another are in face-sharing contact in a web between two adjacent cylinders.

10. The system of claim 9, wherein the first ducts are spaced away from the second ducts.

11. The system of claim 9, further comprising a controller with computer-readable instructions stored on non-transitory memory thereof that when executed enable the controller to:

flow coolant to only the second ducts of the cylinders when an engine temperature is less than an ambient temperature by moving the first valve to a fully closed position and adjusting the second valve to an at least partially open position.

12. The system of claim 9, wherein the first ducts are arranged on portions of the cylinder distal to one another, where a first duct of a cylinder of the plurality of cylinders does not touch first ducts or second ducts of the cylinders of the plurality of cylinders.

13. The system of claim 9, wherein there are exactly four cylinders in the plurality of cylinders, and where the four cylinders are arranged in a line comprising a first outer cylinder directly next to a second inner cylinder, the second inner cylinder being directly next to a third inner cylinder, and a fourth outer cylinder being directly next to the third inner cylinder, and where the first outer cylinder and the fourth outer cylinder comprise second ducts arranged directly between them and the second inner cylinder and the third inner cylinder, respectively, and where the second inner cylinder and the third inner cylinder comprise second ducts arranged therebetween and between them and the first outer cylinder and the fourth outer cylinder, respectively.

14. The system of claim 9, wherein the first ducts extend around a first amount of the circumference of a cylinder of the plurality of cylinder and where the second ducts extend around a second amount of the circumference of a cylinder of the plurality of cylinders, and where the first amount is greater than or equal to the second amount.

15. The system of claim 9, wherein regions between each of the cylinder includes a gap, and where the second ducts are arranged in the gap and where the first ducts are arranged outside the gap.

16. A method comprising: adjusting positions of first and second valves in response to a cold-start, the first and second valves fluidly coupling first ducts and second ducts to a coolant system, respectively; and flowing coolant to only second ducts of a plurality of cylinders comprising first ducts and second ducts during a cold-start, where the first and second cylinder and second ducts are in an engine block, where the second ducts are arranged in gaps formed directly adjacent cylinders of the plurality of cylinders in respective webs between adjacent cylinders, and the first and second coolant ducts meandering so as to form loops along the cylinder longitudinal axis at a distance from the cylinder barrel.

17. The method of claim 16, wherein the adjusting includes closing the first valve and at least partially opening the second valve, and where the first ducts are arranged outside of the gaps.

18. The method of claim 16, further comprising flowing coolant to both the first and second ducts outside of the cold-start, where flowing coolant to both the first and second ducts includes at least partially opening both the first and second valves.

* * * * *